350-96.2

4/5/83 XR 4,379,289

No Sub.

United States Patent [19]

Peek

[11] 4,379,289

[45] Apr. 5, 1983

[54] FIBER OPTICS SECURITY SYSTEM

[75] Inventor: S. Christopher Peek, Andover, Mass.

[73] Assignee: GTE Laboratories Incorporated, Waltham, Mass.

[21] Appl. No.: 18,533

[22] Filed: Mar. 8, 1979

[51] Int. Cl.[3] ..... G08B 19/00; G08B 13/18

[52] U.S. Cl. ..... 340/555; 250/227; 340/521; 340/531; 340/600; 340/619; 350/96.2

[58] Field of Search ..... 340/555, 556, 531, 380, 340/545, 594, 619, 590, 584, 521, 679; 600; 250/227; 350/96.2

[56] References Cited

U.S. PATENT DOCUMENTS

| | | | |
|---|---|---|---|
| 754,555 | 3/1904 | Fred | 340/590 |
| 1,827,366 | 10/1931 | Kertz | 340/545 |
| 2,745,926 | 5/1956 | Mullally | 340/590 |
| 3,277,457 | 10/1966 | Herman | 340/590 |
| 3,566,385 | 2/1971 | Lawson | 340/600 |
| 3,588,811 | 6/1971 | Prickett | 340/380 |
| 3,683,352 | 8/1972 | West et al. | 340/557 |
| 3,704,461 | 11/1972 | Rose et al. | 340/556 |
| 3,805,066 | 4/1974 | Chijuma et al. | 250/227 |
| 4,069,838 | 1/1978 | Hansel et al. | 250/227 |
| 4,118,105 | 10/1978 | Voigt | 250/227 |
| 4,134,022 | 1/1979 | Jacobsen | 340/619 |
| 4,159,420 | 6/1979 | Tsunoda | 340/619 |

FOREIGN PATENT DOCUMENTS

| | | | |
|---|---|---|---|
| 2737499 | 2/1979 | Fed. Rep. of Germany | 350/96.2 |

*Primary Examiner*—Glen R. Swann, III
*Attorney, Agent, or Firm*—Fred Fisher

[57] ABSTRACT

Closed loop fiber optic link means, transferring energy from a radiant source to a receiver, includes serially connected fiber optic links and detectors. Energy cessation causes alarm. Detectors include: (1) A pair of optical transducers oriented whereby light, air transmitted, is received with insignificant loss. In water, light received is so insignificant that energy to the receiver ceases. The first transducer provides a light beam within a constant index of refraction medium to the second transducer spaced and oriented to ordinarily receive the light beam. When light passes through media having different refraction indices at non-normal angles, light is refracted whereby receiver energy ceases. The transducers are oriented in a straight inclined path. (2) Optical fiber, stable to approximately 135° F., which melts above approximately 155° F., provides fire detection. (3) A bimetallic element attached to one of axially aligned optical fiber holders, when heated, mis-align the fibers. A snap action bimetal device displaces at a specific temperature. (4) A connector holds optical fiber and condensing lens for narrow light beam emergence. A second connector, holding the end of a second fiber in proximity to a second lens focus, is axially aligned with the first so that the second fiber transmits light. Opaque objects therebetween interrupt the beam causing energy cessation. (5) Opening of an entrance device having optical fibers coupled in axial alignment to opposite sides thereof causes the fibers to mis-align, causing energy interruption. The radiant energy source and receiver are in proximity to each other.

5 Claims, 2 Drawing Figures

FIBER OPTICS SECURITY SYSTEM

BACKGROUND OF THE INVENTION

1. Field of the Invention

The invention relates to security systems and, in particular, to home security systems utilizing a plurality of fiber optic detection means. Accordingly, it is a general object of the invention to provide new and improved systems of such character.

2. Description of the Prior Art

Previous security systems for the home have utilized independent transducers which detect heat, smoke or intrusions and are either connected to independent logic elements which ultimately cause the excitation of an alarm or are connected to a central logic circuit which integrates all inputs. The varied nature of the transducers make installation complicated or utilize costly communication techniques such as power line carrier, radio or low voltage interconnection cables.

Most contemporary security systems are dependent upon electrical energy for their function and communication with the alarm circuit. They require either battery backup or must rely on the continued supply of house current during potential emergencies. Many are self-contained units with the alarm at the remote site.

SUMMARY OF THE INVENTION

Another object of this invention is to provide a new and improved security system primarily oriented toward residential use which is easy to install, fail safe, and provides a multiplicity of security functions at low cost.

Yet another object of this invention is to provide a new and improved security system utilizing a single electro-optic communications loop with transducers all connected in series therewith.

Still yet another object of this invention is to provide a new and improved security system wherein the alarm is located distant from detecting transducers so as to proximately warn the people intended to be protected.

Yet another object of this invention is to provide new and improved fiber optic detectors suitable for use in a fiber optic security system.

In accordance with one embodiment of this invention, a fiber optics security system includes closed loop fiber optic link means having one end coupled to receive energy from a radiant energy source and having an opposite end coupled to provide energy to a radiant energy receiver. The fiber optic link means includes a plurality of fiber optic links and a plurality of detection means in serial connection. A signal indicates when energy to the receiver ceases. The energy source includes a solid state source which is pulsed at a repetition rate. The receiver includes means for detecting radiant energy at that rate.

In accordance with one feature of the invention, one of the detections means includes optical fiber means which is stable at temperatures of up to approximately 135° F. but which melts and causes cessation of energy to the receiver at some temperature above approximately 155° F., thereby providing for fire detection.

In accordance with another feature of the invention, one of the detection means includes a first holding means for holding one end of a first optical fiber, and a second holding means for holding one end of a second optical fiber in axial alignment with the first end of the first optical fiber. Bimetallic element means are attached to the second holding means so that, upon heating of the bimetallic element means, the second holding means is caused to displace, thereby causing displacement of the first end of the first optical fiber with respect to the first end of the second optical fiber. The bimetallic element means can include a snap action bimetal device for causing displacement to occur at a specific temperature.

In accordance with still yet another feature of the invention, one of the detection means includes means coupling one optical fiber to one side of an entrance device, and means coupling a second optical fiber to the opposite side of the entrance device in axial alignment with the one optical fiber. Opening of the device causes the respective ends of the fibers to be misaligned, thereby interrupting the energy provided to the receiver.

In accordance with a still different feature of the invention, the radiant energy source and the radiant energy receiver are in proximity to each other.

Other embodiments of the invention are directed to novel fiber optic detectors:

With one of the embodiments of the invention, a fiber optic detector includes one optical transducer means spaced a distance from, and in alignment with, second optical transducer means. The distance is such that light transmitted by one optical transducer means, through air, is received by the second optical transducer means with insignificant loss. However, light transmitted by the one optical transducer means encounters a significant loss in a water medium, due to its absorption characteristics, whereby light received by the second transducer means is insignificant.

In accordance with another embodiment of the invention, a fiber optic detector includes optical fiber means having stability at temperatures of up to approximately 135° F. so that light is transmittable along the optical fiber means from one end to another, but which melts at some temperature above approximately 155° F., so that light no longer is transmittable along the optical fiber means from one end to another, thereby providing for fire detection.

In accordance with yet another embodiment of the invention, a fiber optic detector includes a first holding means for holding one end of a first optical fiber, and a second holding means for holding one end of a second optical fiber in axial alignment with the first end of the first optical fiber. Bimetallic element means are attached to the second holding means so that, upon heating of the bimetallic element means, the second holding means is caused to displace, thereby causing displacement of the first end of the first optical fiber with respect to the first end of the second optical fiber. The bimetallic element means can include a snap action bimetal device for causing displacement to occur at a specific temperature.

BRIEF DESCRIPTION OF THE DRAWINGS

Other objects, advantages, and features of this invention, together with its construction and mode of operation, will become more apparent from the following description, when read in conjunction with the accompanying drawing, in which.

DESCRIPTION OF PREFERRED EMBODIMENTS

Figures 1, 2:
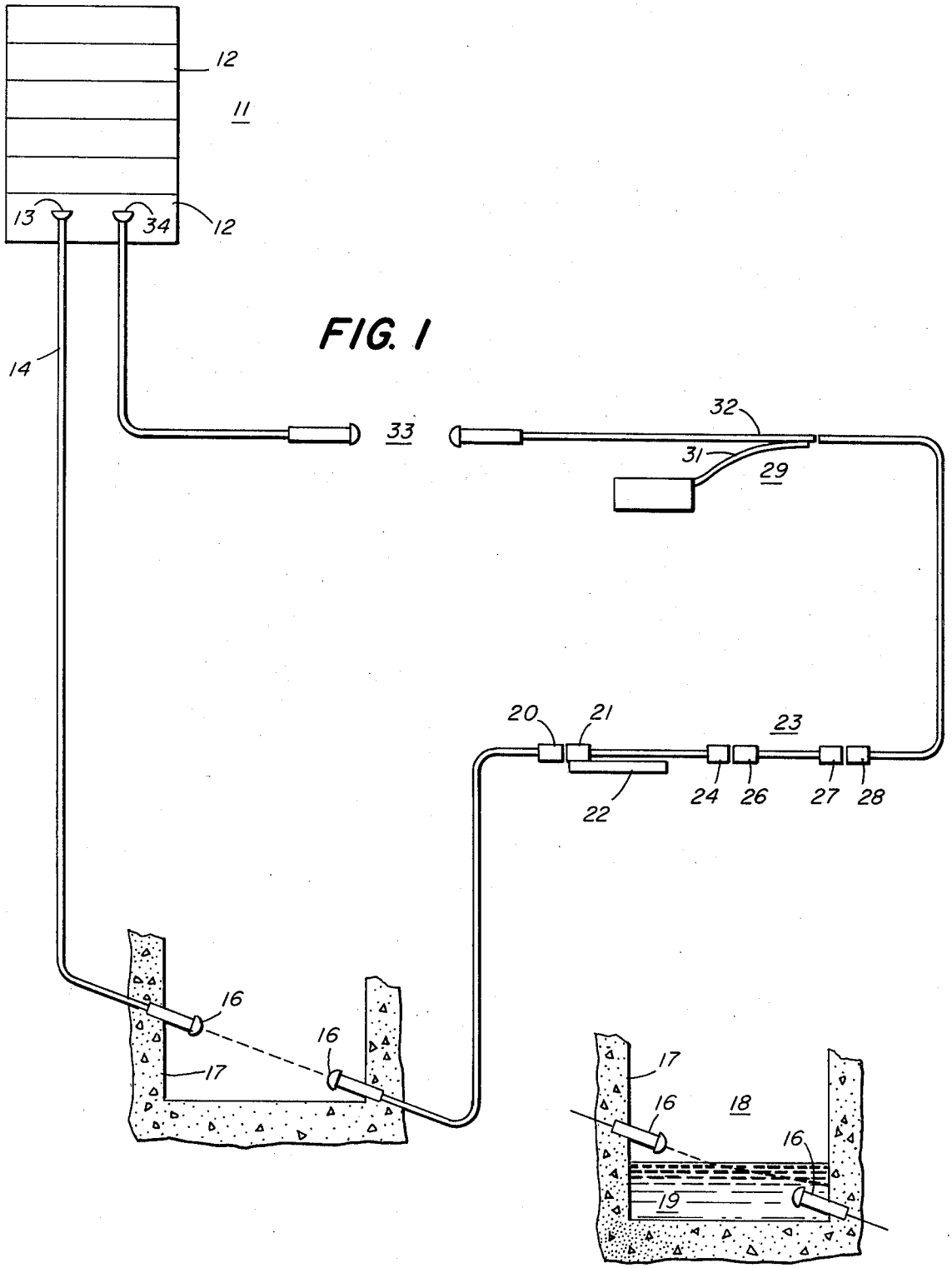
FIG. 1 is a schematic diagram of a fiber optic security system including, as a portion of a serial connection, a pair of optical transducers aligned along a straight inclined axial path.
FIG. 2 is a partial sectional diagram illustrating the two aligned optical transducers of FIG. 1, but where light from one transducer is refracted when light passes from an air medium to a water medium.

The embodiment depicted in FIG. 1 illustrates a complete system such as is installable in a private home. This system preferably utilizes an electronic module circuit assembly (or, modular electronic control assembly) microcomputer system 11 to provide the desired electrical circuitry. Although a dedicated electronic unit can be used to accomplish the logic, driving, and detecting circuits, the preferred embodiments utilize an available microcomputer system.

The microcomputer 11 together with its input/output modules 12, 12 is located, preferably, at the load center in the home where it performs functions such as load shedding, time of day turn down, solar system control, etc. One of the microcomputer modules 12 provides a pulsed current pulse to drive a light emitting diode (LED) source 13 that is contained within the module 12. A plastic fiber optic line 14 is interfaced with the LED source 13 so that a pulsed optical signal is sent down the fiber 14.

Desirably, light is pulsed through a closed loop at a predetermined repetition rate, such as 2 KHz having a 1% duty cycle, and it is detected at the same rate using a synchronous amplifier (although a tuned amplifier is acceptable). When the predetermined repetition rate is not detected, a signal is provided. The plastic fiber 14 is flexible and rugged so that a user can string it about his house without fear of breakage or fear of causing electrical shock. A suitable plastic fiber is commercially available from E. I. duPont de Nemours Co. as PFX cable. Simple connectors can be installed by unskilled people at any point along the fiber 14. The fiber 14 can be cut with a razor blade, inserted into the connector, and polished with a fine emery cloth.

The first transducer 16 in the series string shown in FIG. 1 is a "beam break" type which includes a fiber termination spaced with respect to a lens in such a manner that a narrow beam is projected a distance of about 10 feet in a direction other than vertical or horizontal. The same type of transducer 16 can be used at the opposite end of the space to be protected, for receiving the optical signal. When the two transducers 16, 16 are oriented in a room 17, such as a cellar, near the floor with the two transducers 16, 16 along an axial path other than horizontal or vertical, light can be transmitted from one transducer 16 to the other transducer 16 through a medium having a uniform index of refraction, such as air of uniform temperature. However, light transmitted by one transducer 16 encounters a significant loss in a water medium, due to its absorption characteristics, to cause interruption of the optical path. When light from one transducer 16 passes through media, such as air 18 and water 19, having different indices of refraction at angles other than normal thereto, light produced by the first optical transducer 16 is refracted away (FIG. 2) from the second optical transducer 16, whereby energy to the receiver ceases.

The media having different indices of refraction can be the same substance or medium, such as air, as with some of the air being hot and other of the air being cold. The variable temperature of different portions of air produces a mirage effect, causing light from a transducer 16 to be refracted.

Thus, the presence of water in the cellar could cause an alarm.

The second type of transducer is a "line break" transducer which consists of two couplers 20, 21 placed side by side in such a manner that the optical signal is transmitted from one to the next provided they remain in line. The connector 20 is on one side of an entrance device, such as a door frame (not shown), and the other connector 21 is on the other side of the entrance device, e.g., a door 22. When the door 22 is opened, the optical signal is interrupted.

A similar arrangement is used for a window 23. A connector 24 is on the left side of a window frame (not shown) and its mating connector 26 is on the window 23. An optical fiber couples the connector 26 to a connector 27 on the other side of the window 23. The mating connector 28 to the connector 27 is located on the right side of the window frame.

A third type of transducer, again dependent upon optical fiber technology, is a "temperature sensing" transducer 29. The fiber can be terminated as before in the case of the second transducer, but in this case a bimetal element 31 causes the fiber 32 to be displaced, thereby interrupting the optical path. Heat exceeding a certain fixed value causes this displacement. Preferably, the bimetallic device is of a snap action design so that no displacement occurs until the temperature exceeds a certain value.

The fourth transducer 33, which may again be of the "beam break" type, can be used as an intruder detector or as a smoke detector. When an intruder interrupts the beam, the optical signal does not continue along the optical fiber path, and this interruption is detectable at the end of the fiber loop, as described later.

Most prior art smoke detectors that are commercially available depend upon the detection of smoke over very short paths. The presence of smoke diffuses light, and thereby causes loss of radiant energy to the associated transducer. The "beam break"0 optical transducer 33, described herein, enables one to detect smoke over a long path and at low cost. The longer path makes the "beam break" smoke detector much less sensitive to false signals or gain drifts.

The transducers described above can be repeated several times throughout the house and outdoors as well. Of course, multiple loops can be employed by adding more modules at the control center.

Finally, the fiber 14 is terminated at the control center which, in this embodiment, utilizes a standard LED driver module such as the GTE Electrical Equipment Group Model No. RO-1, which in turn uses a silicon detector as the receiver 34.

The foregoing invention has various advantages over prior art systems due to (1) simple installation, since the fiber is passive and utilizes transducers which accommodate the same type of connectors, (2) low cost, since only one control module is used to perform the described functions, (3) its failsafe nature, since it depends on beam interruption, the fibers (having a low melting temperature) acting as temperature detectors themselves, (4) standby power, if necessary, has only to be provided at the control center, and no lines are needed for carrying power for interconnection, (5) its control center can be accomplished by a microcomputer which can be used for other purposes, thus further defraying cost, and (6) electrical noise, if present, does not couple to the optical fiber, thus minimizing trouble.

Various modifications will suggest themselves to those skilled in the art, without departing from the spirit and scope of this invention. It is desired that this invention be construed broadly and that it be limited solely by the scope of the appended claims.

As used in this specification, including claims, the term "light" is to be construed broadly and is meant to include the broad range of radiant energy including infrared. "Light" in the infrared spectrum is preferred because it is not visible light, and, hence, it is suitable for intruder detection.

What is claimed is:

1. A fiber optics security system comprising a radiant energy source including a solid state source and means for pulsing said solid source at a repetition rate;

a radiant energy receiver including means for detecting radiant energy at said rate;

closed loop fiber optic link means having one end coupled to receive energy from said source and having an opposite end coupled to provide energy to said receiver, said fiber optic link means including, in serial connection, a plurality of fiber optic links and a plurality of detection means; and means responsive to cessation of energy to said receiver for providing a signal; wherein one of said detection means comprises a first optical fiber having a first end;

a second optical fiber having a first end;

first holding means for holding said first end of said first optical fiber;

second holding means for holding said first end of said second optical fiber in axial alignment with said first end of said first optical fiber; and bimetallic element means attached to said second holding means, whereby upon heating of said bimetallic element means, said bimetallic element means causes displacement of said second holding means, and, thus, causes displacement of said first end of said first optical fiber with respect to said first end of said second optical fiber.

2. The fiber optics security system as recited in claim 1 wherein said bimetallic element means includes a snap action bimetal device for causing displacement to occur at a specific temperature.

3. A fiber optic detector comprising a first optical transducer means; and a second optical transducer means in alignment with said first optical transducer means, and spaced a distance therefrom, said distance being such that, in air, light transmitted by said first optical transducer means is received by said second optical transducer means with insignificant loss, and in water, light transmitted by said first optical transducer means encounters a significant loss due to the absorption characteristics of water whereby light received by said second transducer means is insignificant.

4. A fiber optic detector comprising a first optical fiber having a first end;

a second optical fiber having a first end;

first holding means for holding said first end of said first optical fiber;

second holding means for holding said first end of said second optical fiber in axial alignment with said first end of said first optical fiber; and bimetallic element means attached to said second holding means, whereby upon heating of said bimetallic element means, said bimetallic element means causes displacement of said second holding means, and, thus, causes displacement of said first end of said first optical fiber with respect to said first end of said second optical fiber.

5. The detector as recited in claim 4 wherein said bimetallic element means includes a snap action bimetal device for causing displacement to occur at a specific temperature.

* * * * *